United States Patent [19]

Kessler

[11] 4,231,475

[45] Nov. 4, 1980

[54] SHIPPING CARTON FOR PILE FABRIC AND A MACHINE FOR WINDING PILE FABRIC ON A REEL

[75] Inventor: Theodore P. Kessler, Rancocas, N.J.

[73] Assignee: Timron, Inc., Moorestown, N.J.

[21] Appl. No.: 22,293

[22] Filed: Mar. 20, 1979

Related U.S. Application Data

[62] Division of Ser. No. 860,963, Dec. 15, 1977, Pat. No. 4,176,803.

[51] Int. Cl.[3] ..... B65D 85/66

[52] U.S. Cl. ..... 206/389; 206/408

[58] Field of Search ..... 206/389, 408, 407; 229/23 C, 23 A

[56] References Cited

U.S. PATENT DOCUMENTS

| | | | |
|---|---|---|---|
| 2,014,901 | 9/1935 | Leopold et al. | 229/23 A |
| 2,922,516 | 1/1960 | Kessler | 206/408 |
| 3,001,641 | 9/1961 | Kessler | 206/408 |

*Primary Examiner*—William T. Dixson, Jr.
*Attorney, Agent, or Firm*—Kenyon & Kenyon

[57] ABSTRACT

A shipping carton is made with a wrapper which is placed between the end frames of a reel. The wrapper has folded over flaps at the transverse edges which are biased against the end boards of the respective frames and abutted at the ends against the hook strips of the reel. The placement of the wrapper between the end frames and the abutment of the flaps against the hook strips serve to strengthen the carton.

The winding machine includes inwardly directed clips on the outer ends of holders on the end frames for holding the hook strips in rigid condition during winding of a pile fabric on the reel.

10 Claims, 8 Drawing Figures

SHIPPING CARTON FOR PILE FABRIC AND A MACHINE FOR WINDING PILE FABRIC ON A REEL

This is a division, of application Ser. No. 860,963 filed Dec. 15, 1977, U.S. Pat. No. 4,176,803.

This invention relates to a shipping carton for pile fabric and to a machine for winding pile fabric on a reel.

Heretofore, various types of reels and shipping cartons have been known for shipping pile fabric. Generally, the reels have been constructed so that a pile fabric can be wound up on pairs of radiating hook strips. In some cases, the shipping cartons have been preformed so as to receive the reels while in other cases, the shipping cartons have been fabricated with the reels as an integrated part. In the latter cases, the reel is usually made with ene frames which include a cardboard plate having projecting ears or flaps along the edges for receiving an encircling sheet of cardboard which acts as a wrapper. Examples of such an integrated carton are described in U.S. Pat. Nos. 2,922,516 and 3,944,157.

Generally, when the fabric is wound on the reels, the reels are supported in a winding machine in such a manner that the free, or outer ends of the hook strips are unsupported. As a result, as winding progresses and as the weight of the fabric supported on the hook strips progressively increases, the hook strips are bowed inwardly of the reel. This creates various problems. First, the inner windings of fabric, which may have been wound and held under proper tension, sag. Thus, the tension in the windings is reduced. In some instances, the inner windings may even fall off the hook strips. Second, when the completely wound reel is placed in a carton, either the hook strips are forcibly bent back to fit flush against the ends of the carton or the hook strips are allowed to form spaces at their free ends relative to the ends of the carton. In either case, the ends of the carton, and particularly the corners, can be easily damaged during shipping due either to excessive stressing of the carton ends or insufficient internal support. In the case of the shipping cartons in which the endboards of a reel are integrated into the carton, the bending of the hook strips during a winding operation creates problems in having a wrapper placed flush about the reel so as to provide a clean block-like shape. Instead, the ends of the carton take on a rounded shape. Thus, during shipping, these cartons can be subjected to damage which can lead to damage of the fabric within the carton.

Accordingly, it is an object of the invention to provide a pile fabric shipping carton which is of relatively rigid construction.

It is another object of the invention to avoid bowing of the hook strips of a reel during winding of pile fabric thereon.

It is another object of the invention to provide an integrated pile fabric shipping carton which is of a smooth block-shape.

It is another object of the invention to provide a shipping carton of relatively simple but rigid construction.

Briefly, the invention provides a shipping carton for pile fabric as well as a machine for winding pile fabric on a reel.

The shipping carton is of integrated nature and comprises a reel having a pair of end frames and a wrapper disposed peripherally about the reel between the end frames. In addition, a suitable means is provided for securing the wrapper to each of the end frames of the reel. The interposition of the wrapper between the end frames serves to stiffen the end frames against sagging under the weight of the packaged pile fabric. Each end frame of the reel includes an endboard of polygonal shape and a plurality of radially disposed hook strips which are secured to the endboard. The wrapper includes a plurality of flaps which are folded inwardly of the wrapper in abutting parallel relation with a respective endboard. In addition, each pair of adjacent flaps has a hook strip disposed therebetween in abutting relation. A means is also provided to secure the outer ends of each hook strip to an endboard. This means constitutes a rivet or the like which passes through a hook strip and an endboard as well as a washer or plate which is disposed between a head of the rivet and the outside surface of an endboard.

Because of the interposition of the flaps between the hook strips of the end frames, the end corners of the shipping carton are reinforced and made rigid. The flaps also reinforce the shipping carton against sagging at the carton edges during shipment, particularly, when other cartons are placed on top.

The wrapper of the shipping carton is disposed entirely within the profile of each endboard of the end frame. In this way, a smooth contour is presented for the shipping carton without projecting ears or flanges. The shipping carton thus takes on a smooth block-shape so as to provide an efficient shape for shipping purposes without occupying excess space.

The means for securing the wrapper to the end frames of the reel can be of any suitable type. For example, the means may be a tape which is secured to and over the seams formed by the endboards and the wrapper. However, since the flaps of the wrapper act as a dust protector, being biased against the endboards, the tape does not have to cover the whole seam formed between an endboard and the wrapper.

The wrapper which is utilized has a plurality of rectangular panels which are disposed about the reel with each panel having a flap extending perpendicularly from each pair of opposite transverse edges. Because the wrapper is disposed in the profile of each endboard, each transverse edge of a panel is disposed in abutment with a respective endboard.

The hook strips which are utilized generally have an L-shape with a hook-containing flange disposed in perpendicular relation to an endboard. In these cases, the hook-containing flange extends radially of the endboard to a corner of the endboard while the flaps of the wrapper are abutted against the opposite sides of the hook-containing flange.

The machine for winding pile fabric on the reel comprises a pair of rotatable holding frames, each of which has a plurality of holding means for securing an outer end of each hook strip of a reel disposed between the holding frames to a holding frame. In one embodiment, the holding means includes a holder which is movably mounted on a holding frame to move between a locking position and an unlocking position relative to an endboard as well as means on the holder to engage with the end frame of a reel.

In particular, the holders are radially disposed on the holding frames and are mounted to move radially between the locking position and the unlocking position. Further, the means on each holder for engaging an end frame is in the form of an inwardly directed clip which is mounted for movement between an endboard and the washer or plate used in securing a hook strip to the endboard. Each clip is also adjustably mounted on a holder in order to adjust to different thicknesses of washers.

In one embodiment, each holding frame is formed of a plurality of radially disposed arms with a holder slidably mounted at the end of each arm. In this case, each holder is of channel shape and is slidably disposed about an arm while a means is provided for securing each holder to the arm for movement between the locking and unlocking positions of the holder. In addition, the clip is movably mounted on the end of the holder and a means is provided for securing the clip to the holder for movement relative to the holder.

When the machine is used, a reel as described above is mounted between the two end frames and the clips of each holder is moved downwardly between a washer or plate and the endboard of each reel end frame. In this way, the outer peripheries of each reel end frame is locked in a rigid manner to the outer ends of the holding frames. Thus, when the fabric is wound on the reel, the hook strips do not deflect or bow under the weight of the fabric but are retained in the originally locked position. After the fabric has been wound on the reel, the wrapper is applied. Because the reel end frames are held in a rigid condition, the wrapper, as described above, can be disposed between the endboards of the reel with the flaps of the wrapper abutted against the respective hook strips. After securement of the wrapper to the reel, the thus completed shipping carton can be removed from the winding machine in a ready-for-shipment condition.

These and other objects and advantages of the invention will become more apparent from the following detailed description and appended claims taken in conjunction with the accompanying drawings in which:

Figure 2:
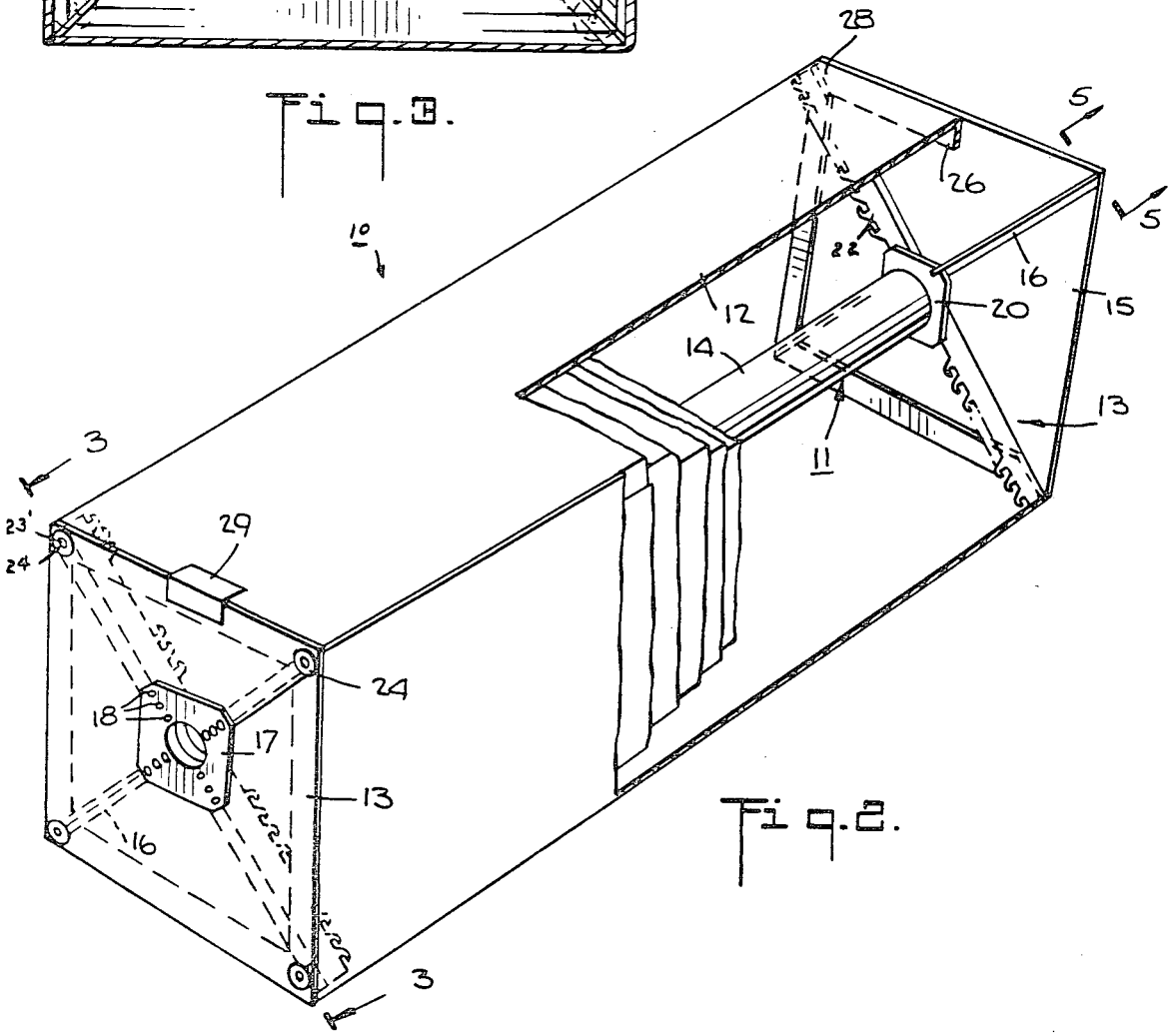
FIG. 2 illustrates a fragmentary perspective view of the shipping carton of FIG. 1.

Referring to FIG. 2, the shippig carton 10 is formed by a reel 11 and a wrapper 12 which is disposed peripherally about the reel 11.

The reel 11 is constructed in generally known manner of a pair of end frames 13 which are held in spaced apart relation by a spacer tube 14 for example of cardboard. Each end frame 13 includes an endboard 15 of polygonal, e.g. rectangular shape, a plurality of radially disposed hook strips 16 and a plate 17 secured to the hook strips 16 in a manner as described in U.S. Pat. No. 3,944,157. As shown, the plate 17 is disposed on the outside of the endboard 15, i.e. on an opposite side of the endboard 15 from the hook strips 16. The plate 17 is secured to the hook strips in metal-to-metal contact via rivets 18. In addition, each end frame 13 also has an apertured lock plate 20 which is mounted on the hook strips 16 to receive the spacer tube 14, again as described in U.S. Pat. No. 3,944,157.

Figure 5:
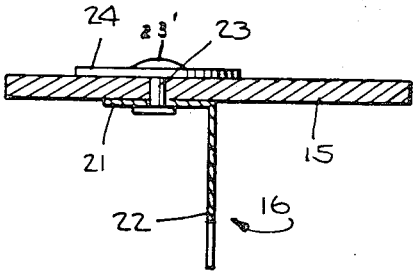
FIG. 5 illustrates a detailed view taken on line 5—5 of FIG. 2.

Each hook strip 16 extends from the plate 17 to a corner of an endboard 15 and is of generally angled shape (FIG. 5). In this regard, each hook strip 16 has a base flange 21 and a hook-containing flange 22 which is disposed in perpendicular relation to the endboard 15. The outer end of each hook strip 16 is secured by a rivet 23 directly to the endboard 15 as shown in FIG. 5. For this purpose, a hole is prepunched in the endboard 15 as well as in the base flange 21 of the hook strip 16 to permit passage of the rivet 23. In addition, a metal washer or plate 24 is disposed between the head 23′ of each rivet 23 and an endboard 15.

Figure 4:
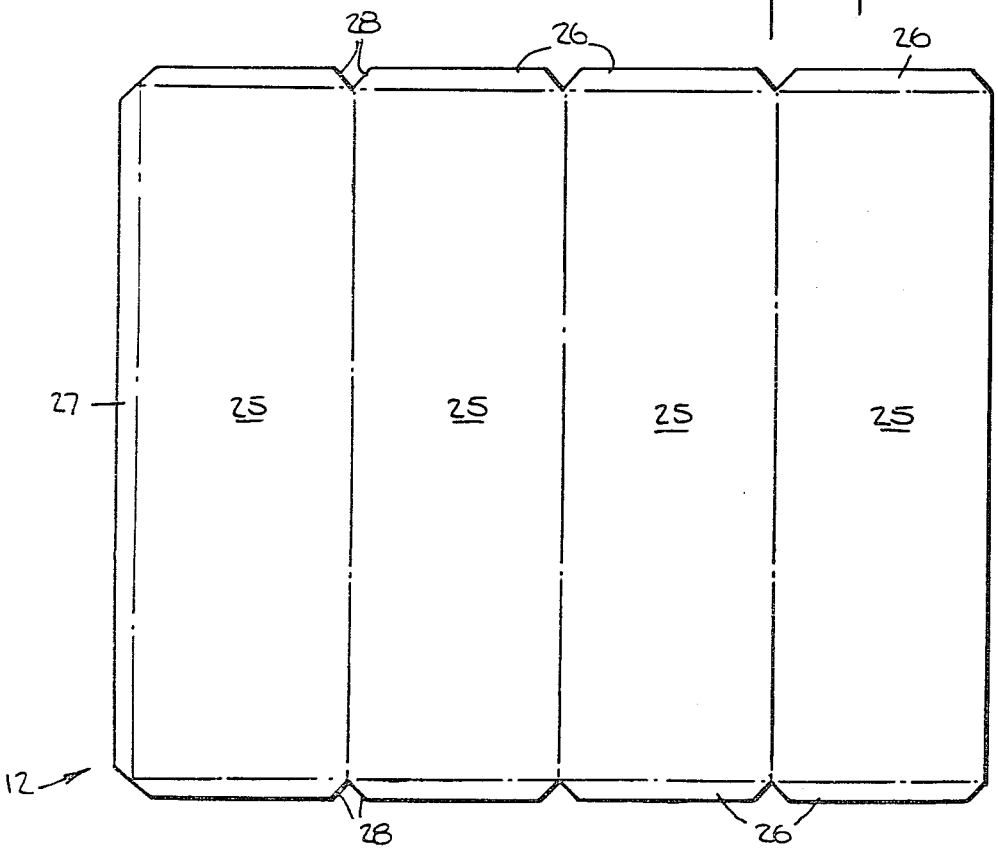
FIG. 4 illustrates a developed view of a wrapper for a shipping carton in accordance with the invention.

The wrapper 12 is of cardboard construction, for example, a double wall 350 pound test, ¼ inch thick board. As shown in FIG. 4, the wrapper 12 is provided with a series of panels 25, each of which has a flap 26 at each transverse edge. In addition, one terminal panel has a flap 27 along a longitudinal edge.

Figure 3:
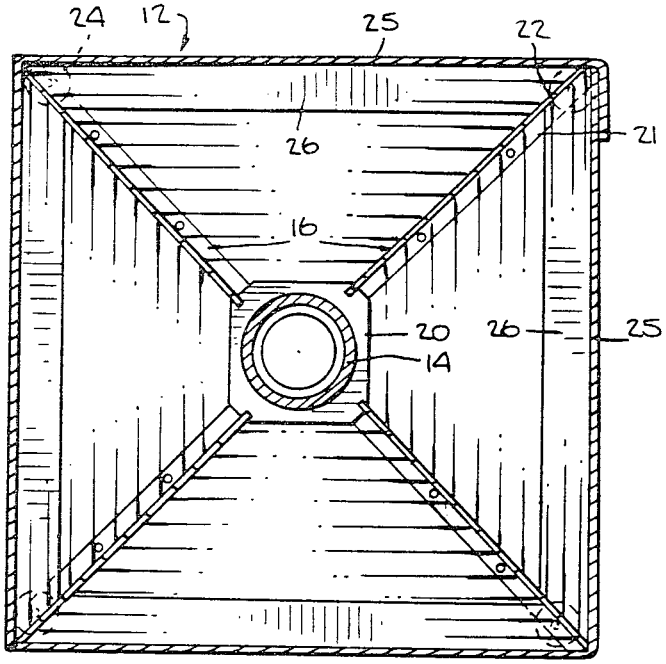
FIG. 3 illustrates a view taken on line 3—3 of FIG. 2.

Referring to FIG. 2, the wrapper 12 is disposed entirely within the profile of each endboard 15 of an end frame 13. In addition, the flaps 26 are folded inwardly of the wrapper and are disposed in abutting parallel relation with a respective endboard 15. Because of the inherent resiliency of the flaps 26, the flaps 26 are biased slightly against the endboards 16 to form a dust seal. Also, as shown in FIG. 3, each pair of adjacent flaps 26 has a hook-containing flange 22 of a hook strip 16 disposed therebetween in abutting relation. In order to accommodate the abutting relationship between the flaps 26 and the hook-containing flanges 22, each flap 26 has a chamfered edge 28.

The flap 27 of the wrapper 12 is disposed in overlying relation to a terminal edge of the panel 25 at the opposite end of the wrapper 12 and is secured thereto by any suitable means, for example, as described in my pending U.S. Pat. Application Ser. No. 605,442, in order to close the wrapper 12 about the reel 11.

Figure 1:
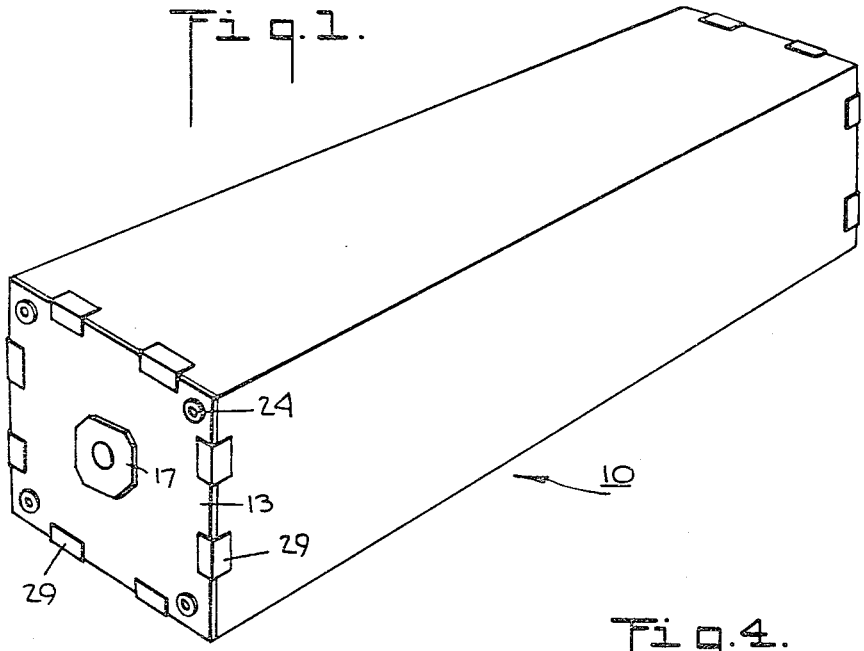
FIG. 1 illustrates a perspective view of a shipping carton constructed in accordance with the invention.

Referring to FIGS. 1 and 2, a suitable means, such as tape 29 is provided to secure the wrapper 12 to each of the end frames 13 of the reel 11. To this end, the tape 29 may be continuous about each end of the carton 10 or may be discontinuous as the flaps 26 of the wrapper 12 are biased against each respective endboard 15 to seal the same.

In order to assemble the wrapper 12 about a fabric wound reel 11, the flaps 26 of the wrapper 12 are folded inwardly. Thereafter, the wrapper 12 is positioned about the reel 11 with the flaps inserted between and in abutting relation to the hook-containing flanges 22 of the respective hook strip 16. The flap 27 of the wrapper 12 is then placed over the opposite terminal edge of the wrapper 12 and secured thereto by the tape 29. The carton 10 is then ready for shipping.

Referring to FIG. 2, when the wrapper 12 is in place relative to the reel 11, the wrapper 12 abuts the outer periphery of each endboard 15 in perpendicular relation from within the reel 11. Thus, the wrapper 12 serves to buttress the shipping carton 10 against the weight of the fabric F on the hook-containing strips 22. In particular, the wrapper 12 strengthens the reel 11 against bowing of the hook strips 22 into the carton 10.

Figures 6, 7:
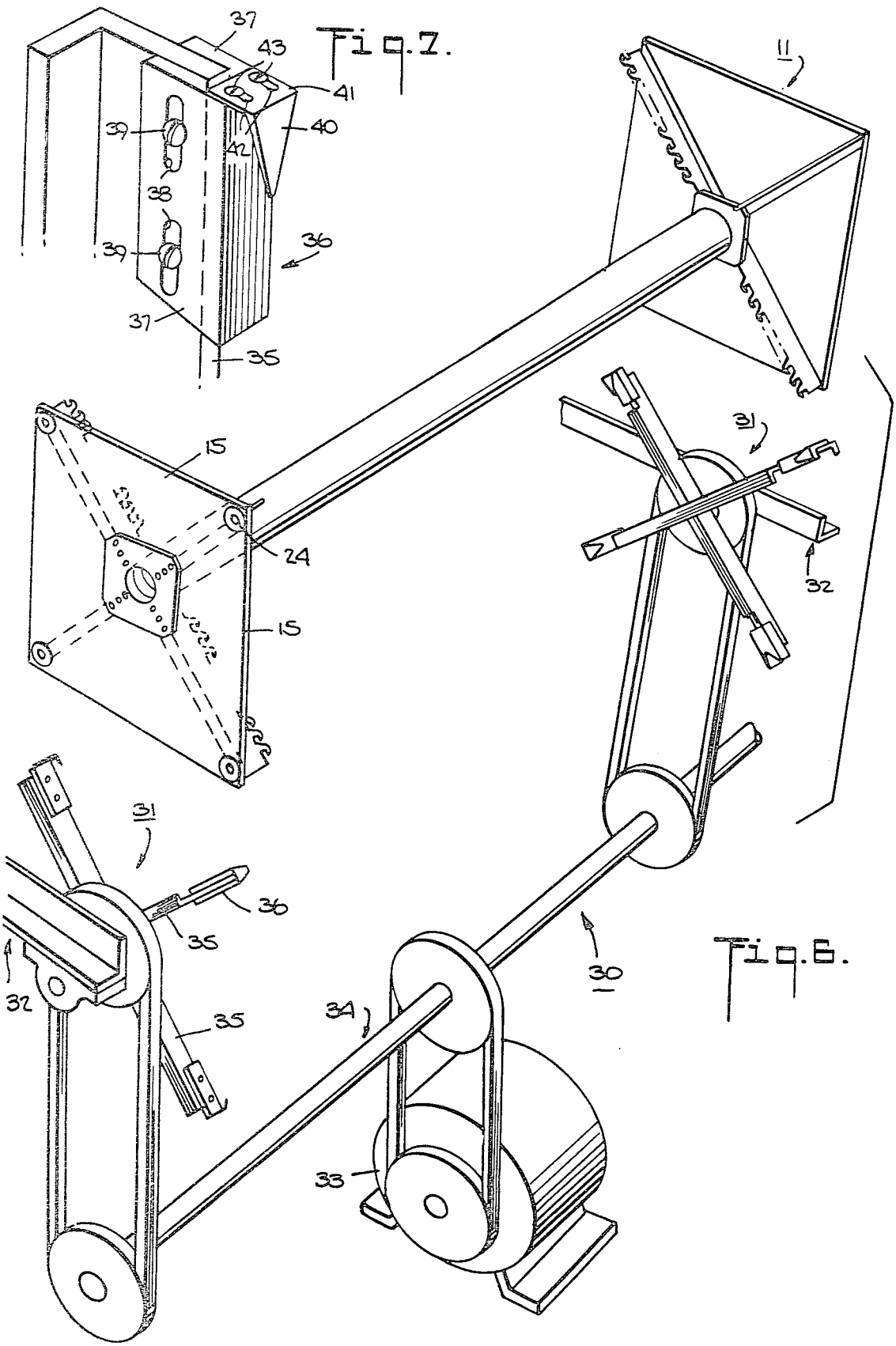
FIG. 6 illustrates an exploded perspective view of a machine for winding pile fabric on a reel.
FIG. 7 illustrates a perspective view of a holder of the machine of FIG. 9.

Referring to FIG. 6, the machine 30 for winding a pile fabric on the reel 11 includes a pair of rotatable holding frames 31 of generally known construction which are mounted in a suitable support structure 32 (shown in part) and a means for rotating the holding frames in synchronism. This means includes a drive motor 33, and a transmission 34 for driving the rotatable holding frames 31 in synchronism. Such a construction is generally known and no further description need be added.

As shown, each holding frame 31 has a plurality of radially disposed metal arms 35 for example of channel-shape, each of which has a holder 36 disposed in a flange-less portion at the outer end. The holders 36 which are thus radially disposed, are mounted on the arms 35 to move radially of the holding frame 31 between a locking position and an unlocking position relative to an endboard 15 of the reel 11. To this end, each holder 36 is of channel shape and has two legs 37 which are slidably disposed about an arm 35 (FIG. 7). The legs 37 of each holder 35 are provided with elongated slots 38 to accommodate a means such as bolts 39 for securing the holder 26 to the arm 35 for movement between the locking and unlocking positions.

Each holder 36 also carries metal clip 40 which is of generally triangular shape and which is directed radially inwardly of the holding frame 31 for movement between a washer 24 and an endboard 15 (FIG. 8) when the holder 36 is in the locking position. The clip 40 is mounted on the holder 36 via an integral flange 41 which has a pair of elongated slots 42 through which bolts 43 pass into the holder 36. The clip 40 is thus adjustably mounted on the holder 36 so as to adjust e.g. to different thicknesses of washers 24.

Figure 8:
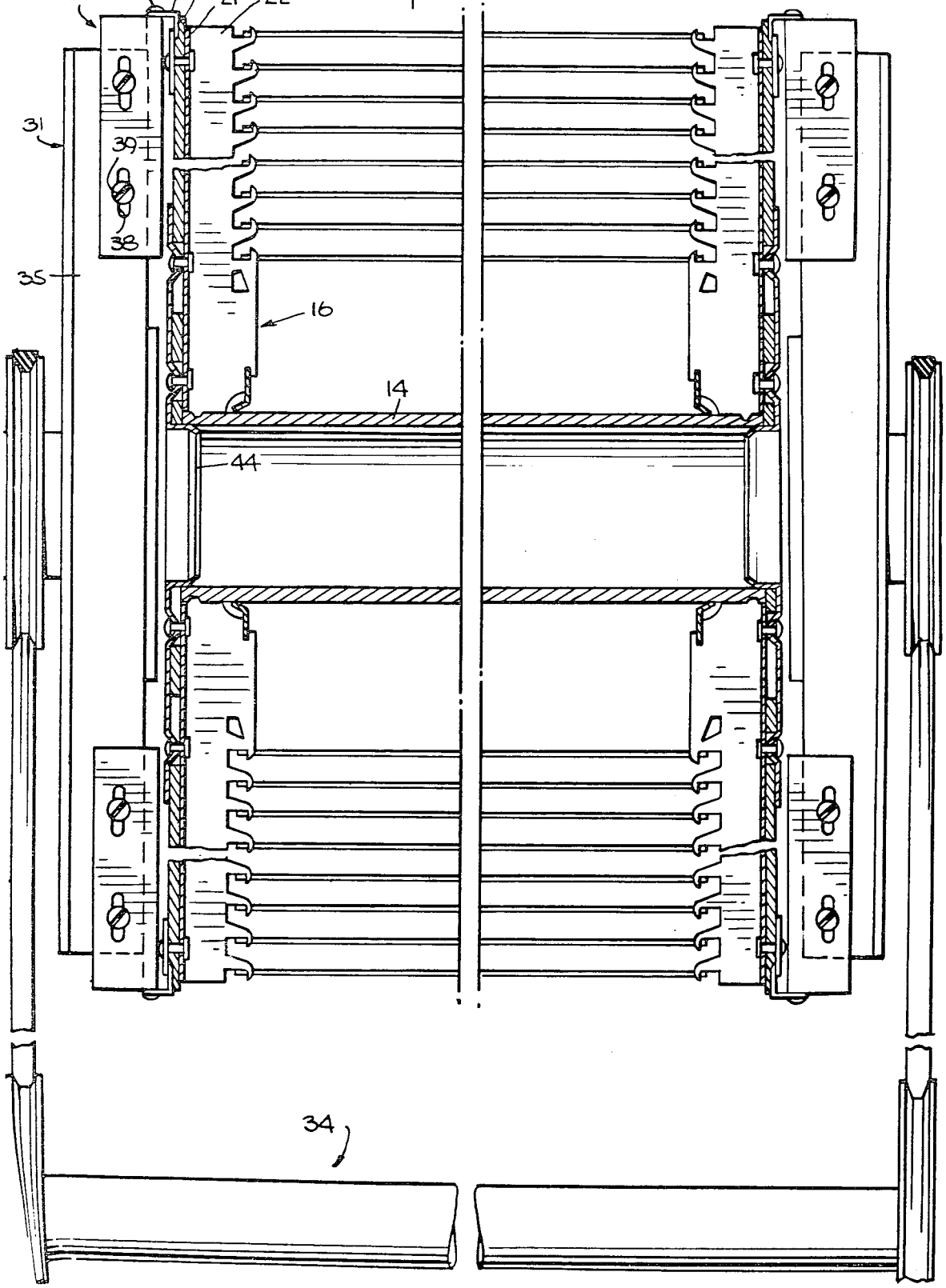
FIG. 8 illustrates a cross-sectional view of the machine of FIG. 6 with a reel in place.

The winding machine 30 is of generally known construction and, as shown in FIG. 8, has a locating hub 44 on each holding frame 31 which is fitted into the spacer tube 14 of a reel 11.

In order to wind a fabric on the reel 11, an empty reel 11 is placed between the two end frames 31 of the winding machine 30. Thereafter, the hook strips 16 of each end frame are aligned with the arms 35 of the respective end frame 31. At this time, the holders 36 are slid out to the unlocking position relative to the arms 35. After the hook strips 16 have been located, the holders 36 are pushed inwardly so that each clip 40 fits between a washer 24 (or plate if used instead of a washer) and an endboard 15 (FIG. 8). This operation can be carried out manually. After all the clips 40 have been disposed over the hook strips 16, winding of the fabric on the reel 11 can be started. At this time, the motor 33 is started to cause rotation of the end frames 31 and the reel 11 secured thereon. During winding, the increasing weight of fabric on the hook strips 16 is transferred via the clips 40 and holders 36 to the arms 35 of the holding frame 31. These arms 35, due to their channel shape and material, are sufficiently rigid to maintain the hook strips 16 rigid against inward bowing.

After the reel 11 has been filled with fabric and while the reel 11 is still locked to the machine frames 31, the cardboard wrapper 12 can be applied, as described above, to form a shipping carton.

Since the clips 40 are disposed to the outside of the endboards 13, the clips 40 do not interfere with the wrapping of the wrapper 12 about the reel 11. After the wrapper 12 has been disposed about the reel 11, the holders 36 are moved outwardly so that the clips 40 disengage from between the washers 23 and the endboards 15. The resulting shipping carton can then be removed from the winding machine 30.

It is to be noted that the insertion of the clips 40 between the washers 23 and the endboards 15 anchors the hook strips 16 against bending up to a 60 pound pull. Alternatively, instead of using the clips, magnets can also be used to hold the outer ends of the hook strips 16 to a holding frame against bending.

What is claimed is:

1. A shipping carton for pile fabric comprising a reel having a pair of end frames, each said end frame including an endboard of polygonal shape and a plurality of radially disposed hook strips secured to said endboard;

a wrapper disposed peripherally about said reel between said end frames, said wrapper having a plurality of flaps folded inwardly of said wrapper in abutting parallel relation with a respective endboard, each pair of adjacent flaps having a respective one of said hook strips disposed therebetween in abutting relation; and means securing said wrapper to each said frame of said reel.

2. A shipping carton as set forth in claim 1 wherein said wrapper is disposed entirely within the profile of each endboard of a respective end frame.

3. A shipping carton as set forth in claim 1 wherein said means includes a tape secured to and over each of said endboards and said wrapper.

4. A shipping carton as set forth in claim 1 wherein said flaps are resiliently biased against each respective endboard.

5. A shipping carton as set forth in claim 1 wherein said wrapper has a plurality of rectangular panels disposed about said reel, each said panel having a respective one of said flaps extending perpendicularly from each of a pair of opposite transverse edges thereof, each said transverse edge of a panel being in abutment with a respective endboard.

6. In a shipping carton for pile fabric, the combination comprising an endboard having a plurality of radially disposed hook strips secured thereto, each said hook strip having a hook-containing flange disposed in perpendicular relation to said endboard; and a wrapper disposed in perpendicular relation to said endboard at the periphery of said endboard, said wrapper having a plurality of flaps along a transverse edge, said flaps being folded inwardly of said wrapper and being disposed in abutting parallel relation with said endboard, each pair of adjacent flaps having a hook-containing flange of a respective hook strip disposed therebetween in abutting relation.

7. The combination as set forth in claim 6 wherein each flap has a chamfered edge abutting a respective hook-containing flange.

8. In a shipping carton for pile fabric, the combination comprising an endboard;

at least one hook strip adjacent said endboard and having a hook-containing flange disposed in perpendicular relation to said endboard; and a wrapper having at least one pair of inwardly folded flaps at a tranverse edge, said flaps being disposed in abutting parallel relation with said endboard and having said hook-containing flange disposed therebetween in abutting relation.

9. The combination as set forth in claim 8 which further comprises means securing said hook strip to said endboard.

10. The combination as set forth in claim 8 wherein said endboard is rectangular, said hook-containing flange extends radially of said endboard to a corner of said endboard, and said wrapper is disposed entirely within the profile of said endboard.

* * * * *

UNITED STATES PATENT AND TRADEMARK OFFICE

CERTIFICATE OF CORRECTION

PATENT NO. : 4,231,475

DATED : November 4, 1980

INVENTOR(S) : Theodore P. Kessler

It is certified that error appears in the above—identified patent and that said Letters Patent is hereby corrected as shown below:

Column 1, line 18, change "ene" to --end--

Signed and Sealed this

*Twenty-fourth* Day of *March 1981*

[SEAL]

*Attest:*

RENE D. TEGTMEYER

*Attesting Officer*

*Acting Commissioner of Patents and Trademarks*